US005102174A

United States Patent [19]

Prevot

[11] Patent Number: 5,102,174

[45] Date of Patent: Apr. 7, 1992

[54] GEARING FOR ESPAGNOLETTE FITTING

[75] Inventor: Gerard Prevot, Willerwald, France

[73] Assignee: Ferco International Usine de Ferrures de Batiment, Sarrebourg, France

[21] Appl. No.: 648,721

[22] Filed: Jan. 31, 1991

[30] Foreign Application Priority Data

Feb. 5, 1990 [DE] Fed. Rep. of Germany ..... 9001276

[51] Int. Cl.[5] ..... F05C 9/18

[52] U.S. Cl. ..... 292/336.3; 292/39; 292/142

[58] Field of Search ..... 292/22, 39, 51, 112, 292/160, 172, 142, 199, 279, 280, 336.3

[56] References Cited

U.S. PATENT DOCUMENTS

| | | | |
|---|---|---|---|
| 1,119,875 | 12/1914 | Richards | 292/160 |
| 1,179,731 | 4/1916 | McDonald | 292/39 |
| 1,504,176 | 8/1924 | Wright | 292/39 |
| 1,900,503 | 3/1933 | Kemp | 292/39 |
| 2,393,788 | 1/1946 | Lofgren | 292/39 |
| 4,335,816 | 6/1982 | Rager | 292/39 |
| 4,616,864 | 10/1986 | Douglas | 292/39 |

FOREIGN PATENT DOCUMENTS

| | | | |
|---|---|---|---|
| 124460 | 11/1984 | European Pat. Off. | 292/51 |
| 2725982 | 1/1978 | Fed. Rep. of Germany | 292/39 |
| 3300423 | 7/1984 | Fed. Rep. of Germany | 292/39 |
| 1461604 | 11/1966 | France | 292/160 |
| 503995 | 12/1954 | Italy | 292/39 |

*Primary Examiner*—Eric K. Nicholson
*Attorney, Agent, or Firm*—Chilton, Alix & Van Kirk

[57] ABSTRACT

A gearing for use in a fitting for a door leaf or window leaf having a frame profile including a guide groove on the movable frame open in the direction of the rabbet space between the movable and stationary frames of the door or window. The positioning rod gearing comprises a partially insertable gearing housing (7) and a guide section (*7c*). A connecting slide (19) is supported in a longitudinally shiftable manner in the housing guide part (*7c*) which slide comprises a coupling extension (21) on at least one end for coupling a positioning rod (22). A drive pinion (13) which is rotatably supported in the housing (7) can be rotated by means of an operating handle of the positioning rod gearing and meshes with a cogging (17) of the connecting slide (19). The drive pinion (13) is a stepped pinion having a large gear rim (13*a*) which meshes with the cogging (17) of the connecting slide (19) whereas the smaller gear rim (13*b*) meshes via a transmission pinion (12) with an actuating pinion (11) which can be rotated by an operating handle. The invention is particularly useful in an espagnolette fitting for a window or door.

7 Claims, 2 Drawing Sheets

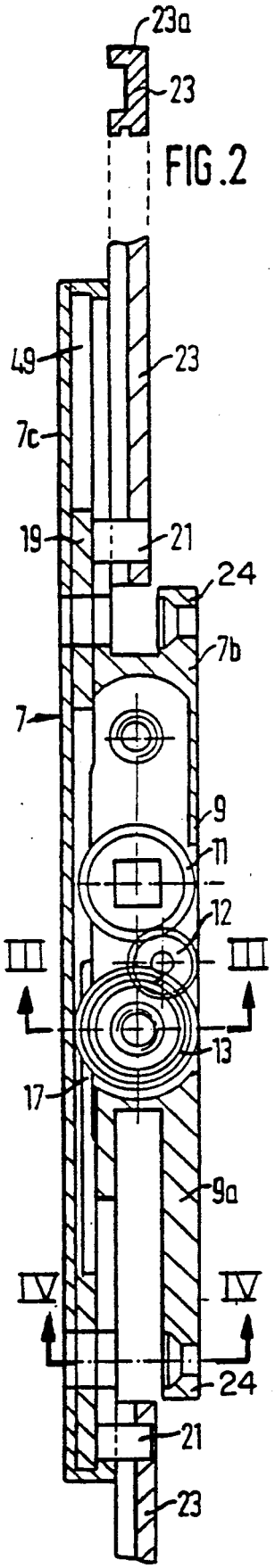
FIG.2
FIG.1
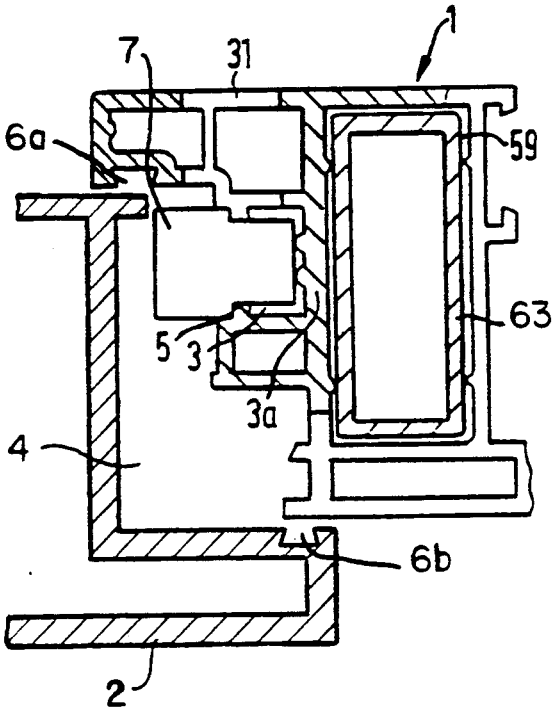
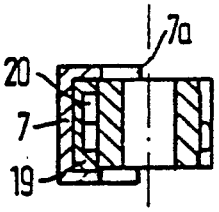
FIG.3
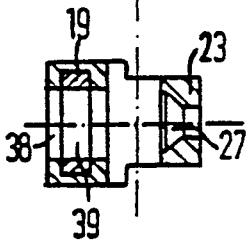
FIG.4

GEARING FOR ESPAGNOLETTE FITTING

BACKGROUND OF THE INVENTION

This invention relates to a positioning rod gearing, and more particularly relates to a positioning rod gearing for operating door leaves, window leaves and similar wall closures.

A positioning rod gearing is known from DE-OS 37 10 056. In positioning rod gearings of this type, the positioning rod must be moved with a 90° or 180° rotation of an operating handle by a stroke or distance of travel, e.g. 17 or 34 mm, which is sufficient for carrying out the necessary unlocking and locking procedures for the desired opening types of the door leaf or window leaf. In order to obtain a sufficient travel distance of the positioning rod, the drive pinion must exhibit a certain minimum radius, which for its part determines the minimum dimension of the gearing housing in the frame plane transversally to the longitudinal direction of the positioning rod. On the other hand, however, the shape of the frame profile dictates the position of the positioning rod and therewith its distance from the swivel pin of a bearing rosette or round anchor plate with an operating handle for the drive pinion of the gearing, which rosette or round anchor plate can be attached to the frame on the room side. A positioning rod gearing of the indicated type, in which the connecting slide actuated by the drive pinion is supported on a guide section of the gearing housing, which section projects into the rabbet space, makes it possible also to be able to use a drive pinion with a sufficiently large radius when the distance between the pivot pin of the drive pinion and the plane of the positioning rod is considerably less than the radius of the drive pinion.

DE-GM 85 15 071 teaches a similar positioning rod gearing; here, however, the drive pinion does not engage with a connecting slide but rather with a section of the positioning rod itself which is offset or bent out in the direction of the rabbet space.

In the previously known positioning rod gearings, the diameter of the drive pinion necessary for obtaining the required distance of travel of the positioning rod is always greater than the distance between the bottom of the guide groove and the plane of the connecting slide. For this reason, the gearing housing has a bulge adapted to the contour of the pinion for whose acceptance in the groove bottom a perforation must be worked in, which is usually performed in that the bore introduced from the inner room side of the leaf profile for receiving the bearing rosette or round anchor plate of the operating handle is designed to be so large that it intersects the groove bottom. However, the positioning of such a perforation in the groove bottom is disadvantageous because it requires additional assembly work and because the leaf profile is weakened. A further disadvantage is the fact that the bulge of the gearing housing projects through the perforation into the hollow chamber of the leaf frame profile where it forms a hinderance, e.g., for the introduction of a metal reinforcement rod into the hollow chamber.

SUMMARY OF THE INVENTION

The invention addresses the problem of designing a positioning rod gearing in such a manner that the width of the gearing housing necessary for receiving the drive pinion can be further reduced at a given connecting slide travel distance in such a manner that the gearing housing can be located entirely above the bottom of the guide groove and does not require any perforation in the groove bottom.

The invention comprises a positioning rod gearing for a door leaf or window leaf having a frame profile including a guide groove on the movable frame open in the direction of the rabbet space between the movable and stationary frames of the wall closure. The positioning rod gearing comprises a partially insertable gearing housing and a guide section. A connecting slide is supported in a longitudinally shiftable manner in the housing guide part which slide comprises a coupling extension on at least one end for coupling a positioning rod. A drive pinion which is rotatably supported in the housing can be rotated by means of an operating handle of the positioning rod gearing and meshes with a cogging of the connecting slide. The drive pinion is a stepped pinion having a large gear rim which meshes with the cogging of the connecting slide whereas the smaller gear rim meshes via a transmission pinion with an actuating pinion which can be rotated by an operating handle. The invention is particularly useful in an espagnolette fitting for a window or door.

BRIEF DESCRIPTION OF THE DRAWINGS

An embodiment of the invention is explained below in more detail with reference made to the drawings, in which:

FIG. 1 shows a section through a leaf frame profile and stationary frame profile when the movable frame is in a closed position, with an outline of the gearing housing set therein;

FIG. 2 shows a longitudinal section through the positioning rod gearing with positioning rods connected to it;

FIG. 3 and 4 show sections through the positioning rod gearing along lines III—III and IV—IV in FIG. 2.

DETAILED DESCRIPTION OF THE INVENTION

Figure 5:
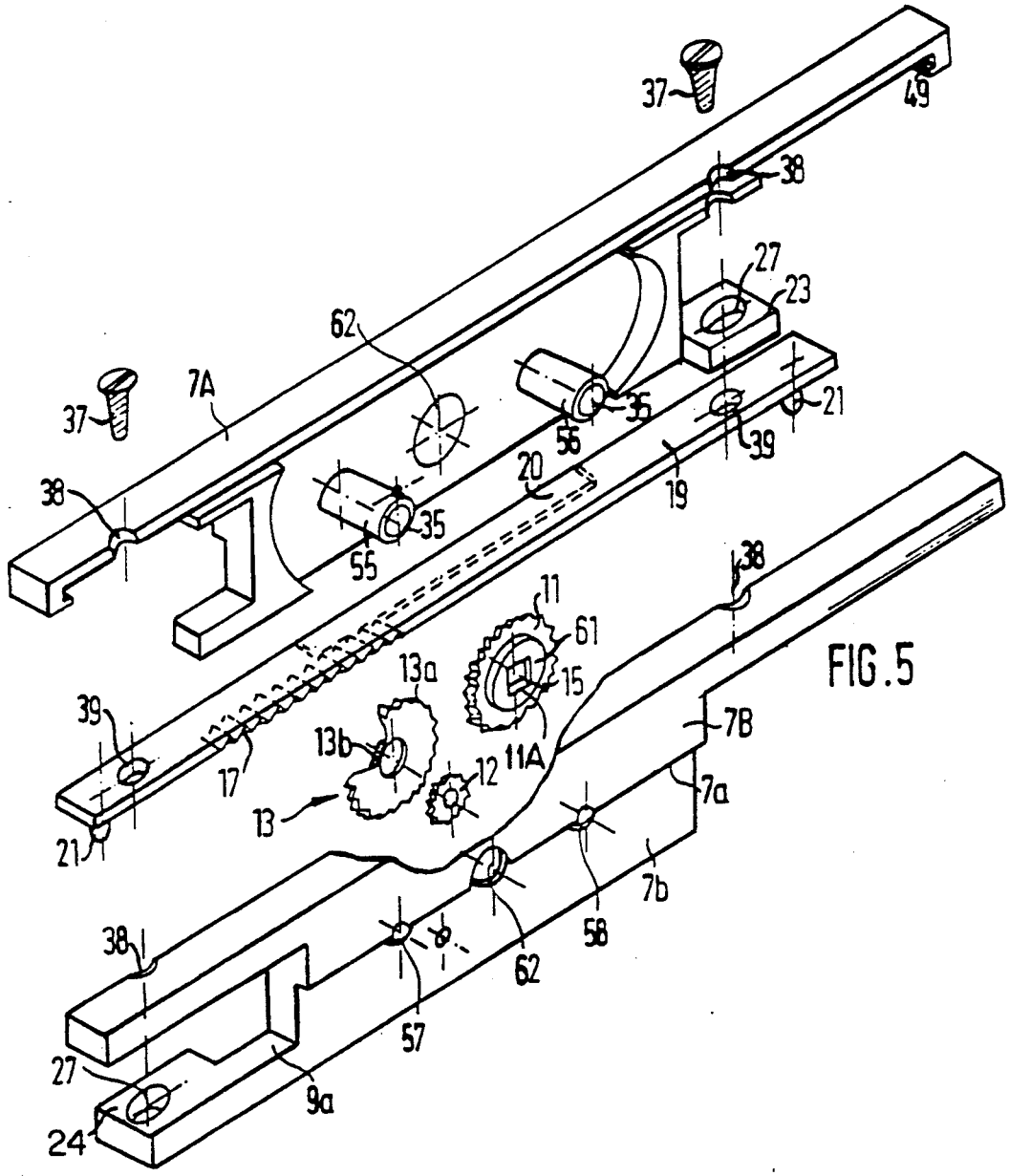
FIG. 5 shows an exploded view of the components of the positioning rod gearing.

According to FIG. 1, the leaf frame profile 1, and the stationary frame profile 2 (simplified illustration), define a rabbet space 4. At least one of dovetail grooves 6*a* and 6*b* holds a sealing gasket (not shown). The leaf frame profile 1, manufactured from metal or plastic, comprises a groove 3 open in the direction of the rabbet space 4 and comprising two inwardly projecting guide flanges 5 in the vicinity of the groove opening. A gearing housing 7 shown in FIG. 2 in a lateral view and in FIGS. 3 and 4 in section can be partially introduced into groove 3 until lateral shoulders 7*a* of gearing housing 7 rest on guide flanges 5.

Gearing housing 7 comprises a housing part 7*b*, as is apparent from FIG. 2, which can be introduced into groove 3 and comprises a housing guide part 7*c* which remains outside of the groove and projects into the rabbet space of the leaf profile. Housing part 7*b* comprises a support surface facing the bottom 3*a* of groove 3 for support on the groove bottom.

Connecting slide 19 is supported in such a manner that it can shift longitudinally in a guide conduit of housing guide part 7*c* formed by opposing grooves 49. The guide conduit is open on the bottom in the end sections of housing guide part 7*c* extending over housing part 7B and connecting slide 19 carries connecting pins 21 by means of which connecting slide 19 can be coupled to positioning rods 23. Each positioning rod 23 has the U-shaped cross-sectional form shown in FIG. 2 with guide grooves 23*a* on the outer sides of the shanks of the U. Guide flanges 5 of guide groove 3 engage in these grooves 23*a* in order to guide positioning rods 23 at a distance from bottom 3*a* of groove 3 and to prevent positioning rods 23 from loosening from connecting pins 21.

Connecting slide 19 carries a cogging 17 on one side of its longitudinal central plane which engages with drive pinion 13 supported in gearing housing 7. Drive pinion 13 is a stepped pinion, as is apparent from FIG. 5, whose larger gear rim 13*a* meshes with cogging 17 of connecting slide 19, whereas the smaller gear rim 13*b* meshes with transmission pinion 12 which is carried by means of a bearing pin (not shown) in gearing housing 7 and meshes for its part with actuating pinion 11. Actuating pinion 11 has the same diameter as larger gear rim 13*a* of drive pinion 13 and, in order not to prevent the rotation of actuating pinion 11, connecting slide 19 comprises a recess 20 on its underside having a length corresponding at least to the length of travel of connecting slide 19. Recess 20 and cogging 17 are located on the one and on the other side of the longitudinal central plane of connecting slide 19 and gear rim 13*a* of pinion 13 and the gear rim of pinion 11 are also offset laterally in relation to one another in a corresponding manner.

Actuating pinion 11 comprises square opening 11*a* for the square pin (not shown) of an operating handle which is introduced through a lateral opening of gearing housing 7. The actuating pinion can be rotated by 90° or 180° with the operating handle. On account of the difference in diameter between pinion 11 and gear rim 13*a* on the one hand and between transmission pinion 12 and the smaller gear rim 13*b* on the other hand, the rotation of actuating pinion 11 is transmitted with appropriate translation onto drive pinion 13 so that the latter can bring about a larger travel distance of connecting slide 19 than corresponds to the angle of rotation and radius of actuating pinion 11.

The diameter of pinions 11 and 13 and therewith the entire width of gearing housing 7 can therefore be designed smaller than was the case previously and the entire gearing housing 7 can be located above bottom 3*a* of guide groove 3 without projecting inadmissibly far into the rabbet space of the window. The positioning of perforations in bottom 3*a* of groove 3 is not required and gearing housing 7 can therefore also not hinder the introduction of a reinforcement rod 63 into hollow chamber 59 of leaf frame profile 1.

In a preferred embodiment illustrated by FIG. 5, gearing housing 7 is composed of two housing halves 7A, 7B which are held together by rivets (not shown) or the like. Two projecting hollow pins 55,56 are designed on housing half 7A which engage into associated openings 57,58 of housing half 7B and in which threaded bores 35 are formed for fastening screws of a gripping rosette or plate for mounting the operating handle (not shown). Drive pinion 13 is also rotatably supported on hollow pin 55. Actuating pinion 11 is designed like a sprocket wheel with projecting bearing pins 61 supported in corresponding bearing openings 62 of housing halves 7A, 7B. Transmission pinion 12 is supported on housing halves 7A, 7B by means of a steering pivot pin which is not shown in FIG. 5.

Housing part 7*b* and its support surface 9 are extended to one side by means of extension 9*a* and two support lugs 24 are formed on the ends of housing part 7*b* as a continuation of support surface 9, each of which lugs comprises a receiving opening 27 for a fastening element, especially a slotted flat-head screw. Support lugs 24 and extension 9*a* are designed to be so flat that they do not hinder the motion of the end of corresponding positioning rod 23 up to the front wall of housing section 7*b*.

Thus, an additional fastening to bottom 3*a* of groove 3 can take place in the gearing shown by means of two screws 37, e.g., self-tapping slotted flat-head screws, which are screwed in through corresponding receiving openings 27 of support lugs 24 into previously positioned threaded bores in groove bottom 3*a*. In order to be able to screw these screws 37 in, corresponding openings 38,39 are provided in alignment with receiving openings 27 in guide section 7*c* of housing 7 and in connecting slide 19 through which openings 38,39 screws 37 and the appropriate screwdriver can be run when connecting slide 19 is located in a preset position, e.g., the downwardly thrust-out position in accordance with FIG. 2. The screwing with screws 37 to groove bottom 3*a* achieves a very reliable positive fixing of gearing housing 7 to frame profile 1 independently of the fastening of the gripping rosette or handle mounting plate.

The above description of what is presently considered to be the preferred embodiment is not intended to limit the scope of the invention. Various modifications and equivalent arrangements are contemplated, and are included within the scope of the claims.

What is claimed is:

1. A gearing for an espagnolette fitting for locking a movable frame to a stationary frame of a wall closure, the movable frame and stationary frame having respective rabbet sides which define a rabbet space, the espagnolette fitting having an operating handle and at least one positioning rod (23) operatively connected to the operating handle and to the gearing, the positioning rod being guided in a groove (3) formed on the rabbet side of the movable frame, the groove (3) having first and second sides and first and second guide shoulders (5) for supporting the positioning rod (23), the guide shoulders projecting inward on the first and second sides of the groove (3) proximate the rabbet side of the movable frame, the gearing comprising:

a gearing housing (7) which comprises a housing part (7*b*) which can be partially inserted into the groove (3), and a guide part (7*c*) remaining outside of the groove, a connecting slide (19) supported in a longitudinally shiftable manner in the guide part (7*c*), which slide has cogging formed longitudinally facing the groove (3) and a coupling extension (21) facing the groove (3) for coupling the slide to the positioning rod (23), a drive pinion (13) rotatably supported in the housing (7), the drive pinion being rotatable by the operating handle, wherein the drive pinion (13) is a stepped pinion having a large gear rim (13*a*) which meshes with the cogging (17) of the connecting slide (19), and a concentric small gear rim (13*b*), and actuating gear means including a transmission pinion (12) which meshes with the small gear rim of the drive pinion, and an actuating pinion (11) which meshes with the transmission pinion and which can be rotated by the operating handle.

2. A gearing according to claim 1, wherein the large gear rim (13*a*) of the drive pinion (13) and the actuating pinion (11) have the same diameter, and the connecting slide (19) extending over the actuating pinion (11) includes a recess facing the actuating pinion (11), the recess having at least the same length as a travel path of the connecting slide (19).

3. A gearing according to claim 1, wherein the transmission pinion (12) has the same diameter as the small gear rim (13*b*) of the transmission pinion (13).

4. A gearing according to claim 1, wherein the large gear rim (13*a*) of the drive pinion and the actuating pinion (11) are arranged in planes parallel to one another on first and second sides of the longitudinal central plane of the positioning rod gearing, and the connecting slide (19) comprises a cogging (17) on the first side and a recess (20) on the second side of its longitudinal central plane.

5. A gearing according to claim 1, wherein at least one receptacle (27) for a fastening screw (37) which can be screwed into a threaded bore of the groove bottom (3*a*) is located in the bottom surface (9) of the gearing housing (7), which surface faces the groove bottom (3*a*).

6. A gearing according to claim 5, wherein an extension (9*a*, 23) projecting in a longitudinal direction is provided on at least a front side of the insertable housing part (7*b*) in which the receptacle (27) for the fastening screw (37) is formed, and an intermediary space for receiving the positioning rod (9*a*, 23) during its travel is provided between the extension (23) and the guide part (7*c*) projecting over the insertable housing part (7*b*).

7. A gearing according to claim 6, wherein insertion openings (38,39) are provided in alignment with the receptacle (27) for the fastening screw in the guide part (7*c*) and in the connecting slide (19) for the introduction of the fastening screw (37) and of a screwdriver.

* * * * *